US008698042B2

(12) United States Patent
Duru

(10) Patent No.: US 8,698,042 B2
(45) Date of Patent: Apr. 15, 2014

(54) COSMETIC APPLICATOR DEVICE INCLUDING A HEATER MEMBER

(75) Inventor: Nicolas Duru, Paris (FR)

(73) Assignee: L'Oreal, Paris (FR)

( * ) Notice: Subject to any disclaimer, the term of this patent is extended or adjusted under 35 U.S.C. 154(b) by 1427 days.

(21) Appl. No.: 12/338,004

(22) Filed: Dec. 18, 2008

(65) Prior Publication Data

US 2009/0159583 A1 Jun. 25, 2009

Related U.S. Application Data

(60) Provisional application No. 61/021,248, filed on Jan. 15, 2008.

(30) Foreign Application Priority Data

Dec. 20, 2007 (FR) ..... 07 60159

(51) Int. Cl.

| | |
|---|---|
| ***A45D 2/48*** | (2006.01) |
| ***A45D 40/26*** | (2006.01) |
| ***A46B 11/08*** | (2006.01) |
| ***H05B 1/02*** | (2006.01) |

(52) U.S. Cl.
USPC ..... 219/201; 219/229; 219/240; 219/241; 219/494; 219/497; 132/218

(58) Field of Classification Search
None
See application file for complete search history.

(56) References Cited

U.S. PATENT DOCUMENTS

| | | | | |
|---|---|---|---|---|
| 2,630,516 | A * | 3/1953 | Rausch et al. | 132/217 |
| 3,012,126 | A * | 12/1961 | Ferguson | 219/494 |
| 4,442,343 | A * | 4/1984 | Genuit et al. | 219/433 |
| 5,775,344 | A | 7/1998 | Clay | |
| 5,853,010 | A | 12/1998 | Suh | |
| 6,040,560 | A * | 3/2000 | Fleischhauer et al. | 219/494 |
| 6,483,687 | B2 * | 11/2002 | Katooka et al. | 361/142 |
| 6,770,853 | B2 * | 8/2004 | Krieger et al. | 219/497 |
| 6,891,130 | B2 * | 5/2005 | Evanyk | 219/240 |
| 7,090,420 | B2 | 8/2006 | De La Poterie et al. | |
| 7,108,438 | B2 | 9/2006 | Fontaine | |
| 7,753,609 | B2 | 7/2010 | Bouix et al. | |
| 8,266,462 | B2 * | 9/2012 | Nakaya | 713/300 |
| 2004/0016741 | A1 * | 1/2004 | Evanyk | 219/221 |
| 2004/0074897 | A1 * | 4/2004 | Krieger et al. | 219/497 |

(Continued)

FOREIGN PATENT DOCUMENTS

| | | | |
|---|---|---|---|
| EP | 1 466 541 | A1 | 10/2004 |
| JP | 2003-310335 | A | 11/2003 |

(Continued)

OTHER PUBLICATIONS

Notice of Allowance in co-pending U.S. Appl. No. 12/339,779 dated Sep. 30, 2011.

(Continued)

*Primary Examiner* — Joseph M Pelham
(74) *Attorney, Agent, or Firm* — Jones Robb PLLC

(57) ABSTRACT

A device for applying a composition may include an independent electrical energy source, at least one heater member that is powered by the independent electrical energy source and a circuit for controlling the power supply to the heater member. The circuit may be configured to power the heater member at least two power settings that differ at least as a function of the depletion state of the independent electrical energy source.

20 Claims, 5 Drawing Sheets

(56) References Cited

U.S. PATENT DOCUMENTS

| | | | | |
|---|---|---|---|---|
| 2005/0205550 | A1* | 9/2005 | Saito et al. | 219/497 |
| 2005/0220828 | A1 | 10/2005 | Ullom et al. | |
| 2006/0005851 | A1 | 1/2006 | Cho | |
| 2006/0032512 | A1 | 2/2006 | Kress et al. | |
| 2006/0157466 | A1* | 7/2006 | Miyazaki et al. | 219/227 |
| 2009/0162128 | A1* | 6/2009 | Duru | 401/1 |
| 2012/0145694 | A1* | 6/2012 | Sousa | 219/211 |

FOREIGN PATENT DOCUMENTS

| | | | |
|---|---|---|---|
| WO | WO 00/40112 | A1 | 7/2000 |
| WO | WO 2007/114551 | A1 | 10/2007 |
| WO | WO 2007/143370 | A2 | 12/2007 |
| WO | WO 2007/143430 | A2 | 12/2007 |
| WO | WO 2007/143430 | A3 | 12/2007 |

OTHER PUBLICATIONS

French Search Report from French Application No. FR 07 60159 filed Dec. 20, 2007.

French Search Report from French Application No. FR 07 60161 filed Dec. 20, 2007.

Co-pending U.S. Appl. No. 12/339,779, fiied Dec. 19, 2008.

European Search Report, from European Patent Application No. EP 08 17 1917, dated May 8, 2009.

* cited by examiner

COSMETIC APPLICATOR DEVICE INCLUDING A HEATER MEMBER

This application claims the benefit of French Application No. 07 60159 filed on Dec. 20, 2007 and U.S. Provisional Application No. 61/021,248 filed on Jan. 15, 2008, which is incorporated by reference herein.

TECHNICAL FIELD

The present teachings relate to devices for applying a composition, such as, for example, a cosmetic composition, by means of a heater member. The present teachings relate more particularly to applicator devices that are powered by an independent electrical energy source, such as, for example, one or more optionally-rechargeable batteries.

BACKGROUND

Such applicator devices are known, in particular for applying a cosmetic composition to the eyelashes.

Some conventional applicator devices include a heater member wherein the temperature of the heater member is regulated by means of a temperature sensor and the current to the heater member is controlled by controlling the current depending on the signal delivered by the temperature sensor. Such regulation that depends on the use of a temperature sensor can be relatively complex and costly. Furthermore, the regulation does not take into account the depletion state of the electrical energy source powering the heater member.

US application No. 2006/0005851 discloses a device in which the temperature of the heater member is regulated by means of a temperature sensor and controlling the current depends on the signal delivered by the temperature sensor.

There exists a need to improve devices for applying a composition, including devices of the aforementioned type.

SUMMARY

The present teachings contemplate devices comprising an independent electrical energy source, a heater member that is powered by the independent electrical energy source, and a circuit for controlling the power supply to the heater member.

According to various exemplary embodiments of the present teachings, the circuit for controlling the power supply to the heater member is configured to power the heater member at least two settings that differ at least as a function of the depletion state of the independent electrical energy source.

Exemplary embodiments of the present teachings may enable the temperature of the electrical heater member to be regulated to some extent, without necessarily providing a sensor that is sensitive to temperature, thereby making it possible to simplify the electrical circuit of the device and reduce its cost.

Exemplary embodiments of the present teachings may make it possible to deliver substantially constant electric power to the heater member regardless of the depletion state of the electrical energy source.

The circuit for controlling the power supply may be arranged to use a "low-power" setting to transfer to the heater member only a fraction of the electric power that can be supplied by the source.

By way of example, such a power setting corresponds to when the independent electrical energy source is at full capacity and the electrical heater member is at its working temperature (also referred to as its service temperature), said working temperature ranging, for example, from about 50° C. to about 90° C., for example, from about 60° C. to about 70° C. In this event, the electric power to be dissipated by the heater member may be less than the electric power that the heater member would dissipate if it was connected directly and continuously to the electrical source.

The circuit for controlling the power supply may be arranged to use a "full-power" setting to transfer to the heater member all of the electric power that can be supplied by the source.

By way of example, such a power setting corresponds to when the heater member is brought from ambient temperature to its working temperature, or to when the electrical energy source no longer has its full capacity, the remaining capacity being less than half its full capacity, for example.

The circuit for controlling the power supply may also be arranged to use a #power-boost setting to power the heater member, in which the electric power dissipated by the heater member is greater than the electric power needed to maintain it at its service temperature.

By way of example, the power-boost setting is useful for bringing the heater member quickly to its service temperature, or for bringing the heater member to a temperature that makes it easier to take up the composition, i.e. a temperature that is higher than its service temperature, for example, a temperature that is higher by more than 10° C.

In an exemplary embodiment, the circuit for controlling the power supply includes a chopper or switch-mode power supply (SMPS) that is arranged to function in step-down mode at one of the power settings, e.g. the above-mentioned low-power setting, and to function in step-up mode in another power setting, e.g. the above-mentioned power-boost setting. The step-up mode may also make it possible to compensate for depletion of the energy source.

In exemplary embodiments of the present teachings, the chopper power supply may function in step-down mode only or in step-up mode only.

When the chopper power supply functions in step-up mode, the heater member may dissipate electric power that is greater than the electric power that would be dissipated by connecting the heater member directly to the independent electrical energy source, the voltage delivered by the chopper power supply being higher.

The circuit for controlling the power supply may be configured to select the electric power setting of the heater member not only as a function of the depletion state of the independent electrical energy source, but also as a function of the operating stage of the device, e.g. namely heating the heater member up to its service temperature, or maintaining said heater member at its service temperature, or heating the heater member up to a temperature that is higher than its service temperature.

The circuit for controlling the power supply may include at least one micro-controller and at least one electronic switch member. The heater member may be connected in series with the electronic switch member, said electronic switch member being controlled by the micro-controller. The chopper power supply may be provided via the micro-controller together with the electronic switch member, or via specialized components.

The circuit for controlling the power supply may be arranged to power the heater member in continuous manner at one power setting, and to power the heater member cyclically at least one other power setting. By way of example, the duty ratio ranges from about 10% to about 100%, for example, from about 67% to about 100%.

The heater member may be powered with a variable duty ratio, and the power settings may differ in their duty ratios.

The duty ratio may be determined by the micro-controller as a function of the depletion state of the independent electrical energy source, the depletion state of the independent electrical energy source being characterized by the voltage at its terminals, for example. By way of example, the duty ratio may thus increase to compensate for a decrease in voltage at the terminals of the energy source, in order to maintain the heater member at its service temperature, e.g. ensuring that the power dissipated by the heater member is substantially constant.

By way of example, a temperature sensor may be used to regulate the temperature more finely.

The device may include only a single heater member, said heater member comprising only a single resistor wire, for example, and being powered by two conductors.

In a variant exemplary embodiment, the device includes two heater members that may be used to heat the same surface of the device that is used to apply the composition, and the circuit for controlling the power supply is configured to power one and/or the other of the heater members as a function of the depletion state of the independent electrical energy source, for example.

By way of example, the circuit for controlling the power supply may be configured to power both heater members simultaneously at one power setting. By way of example, such a power setting corresponds to when the applicator is to be brought quickly to its service temperature after being switched on, and to when the maximum amount of electric power needs to be dissipated.

The circuit for controlling the power supply may be arranged to power only one of the two heater members at another power setting. By way of example, the heater member that is to be powered is selected as a function of the electric power that the heater member is capable of dissipating depending on the voltage of the energy source. Thus, as a function of the depletion state of said energy source, one or the other of the heater members could be powered, depending on their specific electrical characteristics.

In other words, the circuit for controlling the power supply may be configured to power one or the other of the heater members selectively, in particular as a function of the depletion state of the source.

When the depletion state of the source is such that the electrical energy that it supplies no longer enables a single heater member to maintain the applicator at a service temperature that is sufficient, the other heater member may also be powered.

The heater members may be connected in parallel branches, each branch comprising, in series, the heater member and an electronic switch member that is controlled by the circuit for controlling the power supply, e.g. by the above-mentioned micro-controller.

The heater members may also be connected in series, the circuit for controlling the power supply including a switching system that is configured to power all or only some of the heater members, in particular depending on the depletion state of the independent electrical energy source.

The electrical circuit of the device may include a timer system that is arranged to limit the duration of at least one operating stage of the device and/or to limit at least one power setting to a predefined value. The duration may vary as a function of the depletion state of the energy source. By way of example, the device may be arranged to measure the voltage $V_s$ of the source, then to determine the corresponding duration of the operating stage and/or of the power setting, e.g. by calculation or by accessing a table.

When the operating stage corresponds to heating up the heater member to a predefined temperature, said heater member may be powered continuously at the voltage of the source, or at a greater voltage that is permitted by the circuit, for a predefined duration before variable duty regulation begins. This regulation with variable duty ratio may include a periodic measurement of the voltage $V_5$ of the source in order to know its depletion state, and the duty ratio may consequently be modified, e.g. being constant between two consecutive reads of the voltage of the source.

The applicator may include an audible and/or a visible indicator for signaling the depletion of the independent electrical energy source and/or for indicating if the temperature of the heater member has reached a predefined value, in particular its service temperature.

At full capacity, the voltage $V_{smax}$ of the independent electrical energy source may be greater than the heater member voltage $V_w$ that is necessary for maintaining the heater member at its service temperature when powered continuously, the voltage $V_{smax}$ being greater than about 1.2 times $V_w$, for example.

The circuit for controlling the power supply to the heater member may be configured to measure the voltage $V_s$ of the independent electrical energy source on switching on the device, and to power the heater member continuously for a predefined duration $T_1$ as a function of the voltage thus measured in order to bring the heater member to its service temperature or to a higher temperature, so as to take up the composition.

The heater member may be powered with a duty ratio, and the power settings may differ in their duty ratios.

Other exemplary embodiments of the present teachings provide a method of controlling the power supply of an electrical heater member of a device for applying a composition, in which method the heater member is powered at a mean voltage that is less than the voltage supplied by the independent electrical energy source and/or with a first duty ratio that is less than unity when the independent electrical energy source is at a first degree of depletion and when the heater member is to be maintained at its service temperature, and the heater member is powered with a second duty ratio that is greater than the first duty ratio and/or at a voltage that is greater than or equal to the voltage of the electrical energy source when said electrical energy source is at a second degree of depletion that is greater than the first degree of depletion and/or when the heater member is to be brought to its service temperature or to a higher temperature.

The first degree of depletion may correspond to the full capacity of the source.

BRIEF DESCRIPTION OF THE DRAWINGS

The present teachings may be better understood on reading the following detailed description of non-limiting embodiments thereof, and on examining the accompanying drawings, in which.

MORE DETAILED DESCRIPTION

Figure 1:
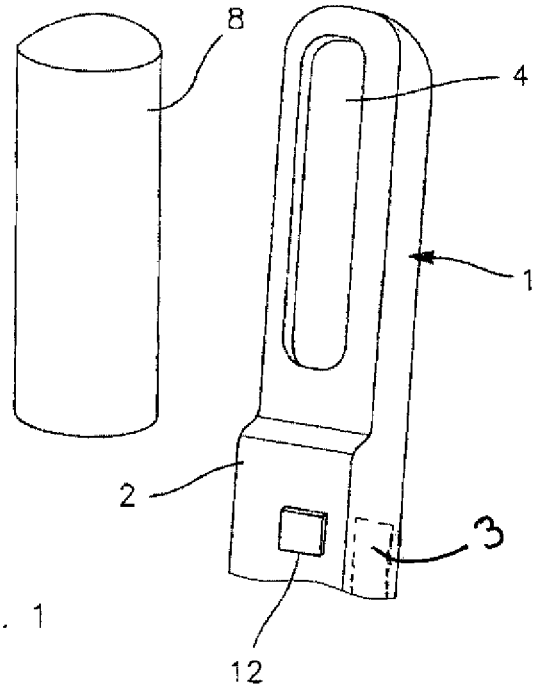
FIG. 1 is a diagrammatic and fragmentary view showing an applicator device made in accordance with an exemplary embodiment of the present teachings.
Figure 2:
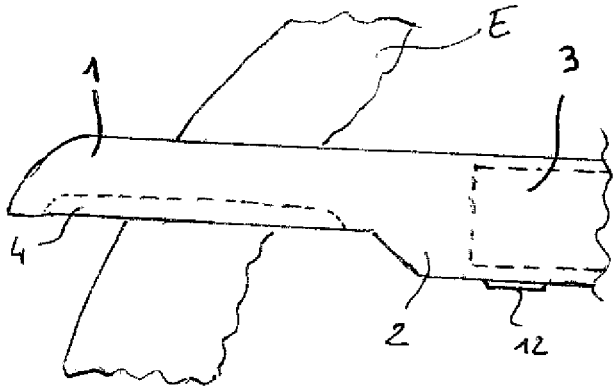
FIG. 2 is a view similar to FIG. 1 of another exemplary embodiment.
Figure 3:
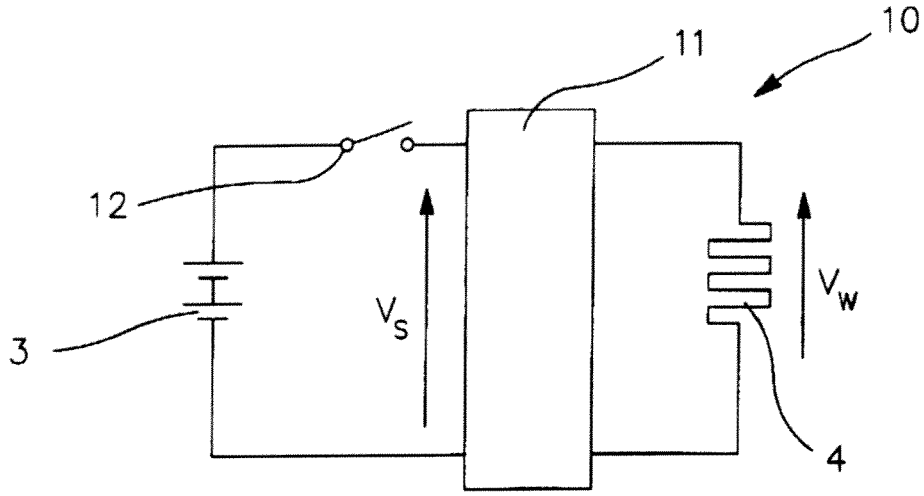
FIG. 3 is a circuit diagram showing a power-supply circuit in accordance with an exemplary embodiment of the present teachings.

The applicator device 1 shown in FIG. 1 comprises a housing 2 configured to house an independent electrical energy source 3, and an electrical heater member 4 that is powered by the independent electrical energy source 3 via an electrical circuit 10, examples of which are shown in FIGS. 3, 4, 7, and 9.

The applicator device 1 may present different shapes, with the housing 2 preferably being elongate.

The heater member 4 shown in FIG. 1 extends along the longitudinal axis of the housing 2. In a variant, the heater member 4 may extend generally across the longitudinal axis. Thus in various embodiments, a user may, for example, apply a cosmetic composition to a skin surface E via the heater member 4.

The heater member 4 may comprise at least one electrical resistor, such as, for example, a nickel-chromium alloy wire. By way of example, the heater member may be as described in any of U.S. Pat. No. 5,853,010, US Application Publication No. 2006/0005851, or JP 2003-3100335, which are incorporated by reference herein.

The independent electrical energy source 3 may comprise one or more batteries. By way of example, the one or more batteries may include 1.5 volt (V) batteries, e.g. of AAA or AA format, or one or more rechargeable batteries, e.g. of polymer-lithium or NiMH type.

The heater member 4 may be carried by a substrate that is molded out of plastics material and integral with at least a portion of the housing 2, for example. The substrate may carry the electrical heater member 4 and not a temperature sensor that would make it possible to measure the temperature of the heater member.

Where appropriate, the substrate may include portions in relief, such as, for example, teeth, for combing the eyelashes, and/or at least one protective portion in relief that seeks to protect the user in the event of accidental contact with the heater member 4, e.g. transverse ribs covering the heater member.

The device 1 may possibly include a protective cap 8 configured to cover the electrical heater member 4. The protective cap 8 may cover the heater member 4 when not in use.

The housing 2 may include an on/off switch 12 and possibly one or more indicator lights (not shown), e.g. for signaling to the user that the heater member is being electrically powered, or for signaling to the user the need to change the independent electrical energy source, inter alia.

When the independent electrical energy source 3 includes one or more rechargeable batteries, the device may possibly be associated with a charger (not shown) making it possible to recharge the rechargeable batteries.

The device includes an electrical circuit 10 that powers the heater member 4 from the source 3. An exemplary embodiment of an electrical circuit 10 is shown schematically in FIG. 3 and includes control means 11 for controlling the power supply to the heater member 4.

By way of example, the control means 11 comprises a micro-controller that is programmed to perform all or some of the desired functions.

The circuit 10 may include a timer that keeps the electrical heater member 4 powered for a predetermined duration after the applicator has been switched on by the user.

By way of example, the control means 11 may be powered when the switch 12 is closed, and the heater member 4 may thus be powered at a power setting that varies, e.g. depending on whether the heater member 4 is being used to apply composition or to add finishing touches to makeup, or whether it needs to be heated up quickly.

By way of example, the heater member 4 is arranged to be powered under a nominal working voltage $V_w$ while being used to apply the composition or to add finishing touches to makeup, supplying power at this voltage ensuring that the heater member is maintained at a service temperature ranging from about 60° C. to about 70° C., for example. At full capacity, the voltage $V_{smax}$ of the independent electrical source 3 is greater than $V_w$. For example, $V_w$ equals 2 V, and $V_{smax}$ equals 3.2 V. By way of example, the heater member 4 is powered at $V_{smax}$ so as to heat up the heater member 4 quickly.

Figure 10:
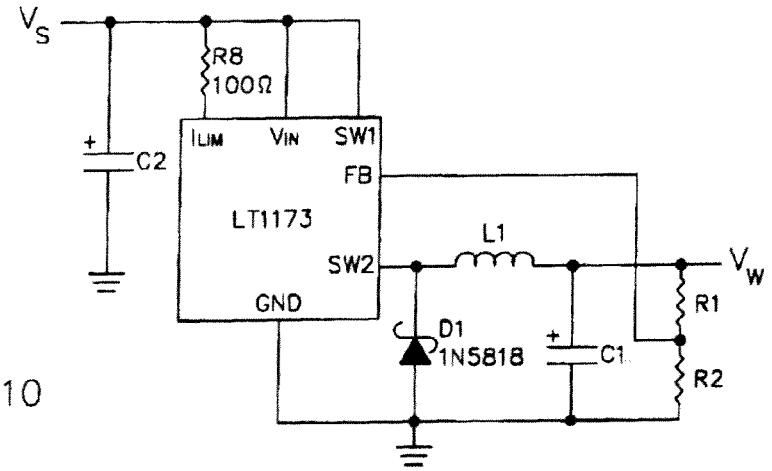
FIGS. 10 and 11 show components of an electrical circuit in accordance with various exemplary embodiments of the present teachings.

By way of example, power is supplied at a voltage $V_w$ that is less than the voltage $V_s$ of the independent electrical source 3 via a chopper power supply, for example, that is provided by the component sold under the reference LT 1173 by the supplier LINEAR TECHNOLOGY as shown in the diagram in FIG. 10, for example. In the exemplary embodiment of FIG. 10, the independent electrical energy source 3 comprises two 1.5 V batteries, and the values of L1, R1 & R2, and C2 are selected as 220 micro Henries (pH) (L1), 100 kilohms (kΩ) (R1 & R2), and 220 microfarads (μF) (C2), respectively, and $V_w$ equals 2V.

The circuit 10 may also be configured to measure the voltage $V_s$ at the terminals of the independent electrical source 3, compare it to the nominal working voltage $V_w$ of the heater member 4, and, as a function of the result of the comparison, act on the setting for supplying power to the electrical heater element.

By way of example, when the voltage supplied by the source 3 is greater than $V_w$, the control means 11 may be configured to supply power to the heater member 4 with a duty ratio that is less than 100%, the duty ratio decreasing with increasing difference $|V_s - V_w|$.

When the voltage supplied by the source 3 is equal to or less than $V_w$ for example, because said source is depleted, the circuit 10 is configured to supply the heater member 4 continuously with a voltage that is substantially equal to $V_w$.

To this end, a step-up chopper power supply may be used.

The use of such a chopper power supply thus makes it possible to use the source 3 until it is thoroughly discharged.

In another variant, the circuit 10 does not enable the voltage of the source 3 to be increased.

Figure 4:
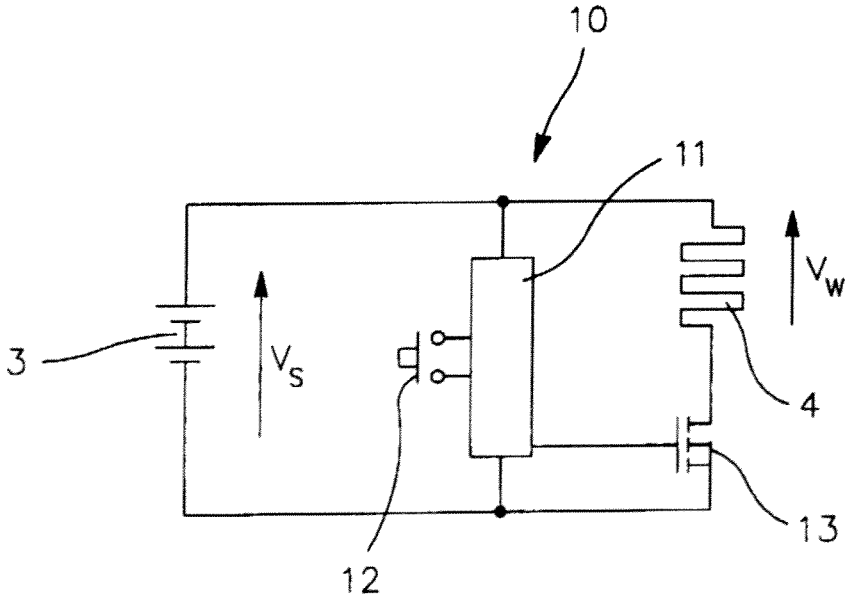
FIG. 4 is a view similar to FIG. 3 showing another exemplary embodiment of a power-supply circuit.

FIG. 4 shows a circuit 10 of another exemplary embodiment of the present teachings, in which the heater member 4 is connected in series with an electronic switch member 13, e.g. a MOSFET transistor.

In this exemplary embodiment, the control means 11 for controlling the power supply is powered permanently by the source 3, but may pass from a standby state, in which the electricity consumption is very small, to an active state in which a certain amount of regulation of the temperature of the heater member 4 is guaranteed.

As may be seen in FIG. 4, the switch 12 may, in this event, provide transient contact, and may be associated with control means 11. Where appropriate, an additional switch (not shown) that chops the general power supply may be provided.

In the exemplary embodiment of FIG. 4, the circuit control means 11 comprises a microcontroller which, after detecting a change in state of the switch 12, is arranged to pass from a standby state to an active state.

In the active state, the micro-controller may be arranged to regulate the temperature of the heater member 4 by acting on the electronic switch member 13.

In an exemplary embodiment of the device shown in FIG. 4, power is supplied to the heater member 4 at a setting that varies as a function of the depletion state of the independent electrical energy source.

The control means 1 may be arranged to chop the voltage $V_s$ in such a manner that the mean value of the voltage at the terminals of the electrical heater member 4 corresponds substantially to $V_w$, when $V_s$ is greater than $V_w$.

Figure 6:
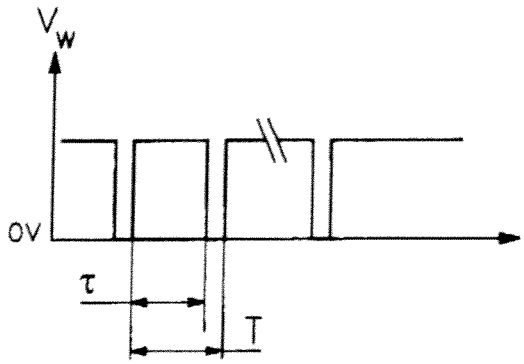
FIG. 6 shows an example of the appearance of the voltage of an electric heater member in accordance with various exemplary embodiments of the present teachings.

In particular, the control means 11 may act on the duty ratio of the power supply to the electrical heater member by opening or closing the electronic switch member 13, the duty ratio being defined as being the value $\tau/T$, as shown in FIG. 6. By way of example, the voltage may be chopped at a frequency 1/T ranging from about 1 hertz (Hz) to about 100 kilohertz (kHz), for example, about 1 kHz.

When, for example, the independent electrical energy source 3 presents a voltage $V_{smax}$ of 3 V at full capacity and the nominal voltage $V_w$ is 2 V, the duty ratio starts off at 67%, then increases as the voltage $V_5$ at the terminals of the source 3 decreases. When the heater member 4 is powered continuously at 2V, its temperature remains in the range from about 60° C. to about 70° C., for example.

When the independent electrical energy source 3 becomes discharged and the voltage $V_s$ is practically close to $V_w$ or is less than $V_w$, the duty ratio is substantially equal to 100%.

The micro-controller may store a correspondence table matching the voltage $V_s$ and the duty ratio to be applied to the voltage delivered to the heater member 4. The table is adapted to a heater member having a predefined working voltage $V_w$.

When the voltage $V_s$ becomes less than $V_w$, the control means 11 may be arranged to inform the user, e.g. by means of a signal that may be, for example, a visible or an audible signal.

In another exemplary embodiment of the device shown in FIG. 4, power is supplied to the heater member 4 at settings that differ as a function of the depletion state of the independent electrical energy source and/or of the operating stage of the applicator, i.e. firstly heating up to its service temperature, or to a higher temperature of the electrical heater member, or secondly maintaining said heater member 4 at the service temperature. This embodiment is described with reference to FIG. 5.

When a user presses on the switch 12 at step 100, the micro-controller detects this action at step 101 and powers the heater member 4 at a first power setting that corresponds to a heating-up stage.

Figure 11:
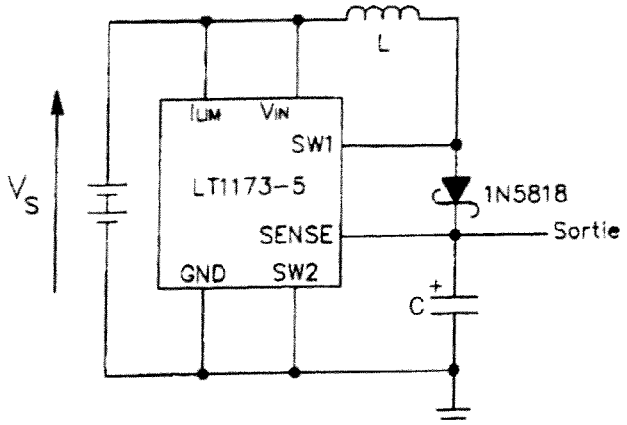

The first power setting may enable the heater member 4 to heat up quickly from ambient temperature, when the applicator device 1 is switched on for use. During this stage, the heater member 4 may be power-boosted, i.e. the electric power that it dissipates is greater than the electric power that corresponds to maintaining it at its service temperature. By way of example, the heater member 4 is powered at a voltage that is greater than $V_s$. By way of example, a chopper power supply, as shown in FIG. 11, may be used to increase the voltage supplied to the heater member 4. In the FIG. 11 example, the independent electrical energy source 3 comprises two 1.5 V batteries, and the values of L and C are selected to be equal to 100 μH and 100 μF, respectively, such that the voltage supplied at the output is equal to 5 V for an input voltage of 3 V.

At step 102, the micro-controller of control means 11 measures the voltage $V_s$ and acts on the switch member 13 so as to power the heater member 4 temporarily for a predefined duration, with a duty ratio that is equal to about 100%.

As indicated above and at the first power setting, the heater member 4 may be powered with a voltage that is greater than its working voltage $V_w$, thereby making it possible to shorten the heating-up time.

Still at step 102, the control means 11 determines the duration $T_1$ during which the heater member 4 is to be powered at the first power setting.

By way of example, the micro-controller stores a correspondence table matching the voltage $V_s$ initially measured with the duration $T_1$.

By way of example, when the initial value of $V_s$ is 3 V, 2.5 V, or 2 V respectively, the duration $T_1$ can be equal to 20 seconds (s), 30 s, or 40 s respectively. In other words, the duration for the stage of powering the heater member at high power can be shorter when the source 3 is depleted little.

The heater member 4 is powered for the duration $T_1$ during step 103.

Then, at step 104, the voltage $V_s$ of the independent electrical energy source 3 is measured once again by the control means 11 for controlling the power supply that may thus power the heater member 4 at least a second power setting, e.g. corresponding to an operating stage in which the heater member 4 is at the service temperature and needs to be maintained at this temperature, which assumes less power is supplied to the heater member 4 than at the first power setting.

By way of example, the control means 11 may determine the duty ratio for the power supply as a function of the voltage measured at step 104. By way of example, the duty ratio is predefined by a correspondence table stored in the micro-controller, having the voltage $V_s$ as its input, for example. In a variant, the duty ratio is determined by the micro-controller using a mathematical function having $V_s$ as the variable.

At step 105, the heater member 4 may be powered with a determined duty ratio for a duration $T_2$, at the end of which the control means 11 detect, at step 106, whether the switch 12 is still actuated, and if so the operations of steps 104 and 105 continue, and if not the device returns to the standby mode at step 100.

Figure 7:
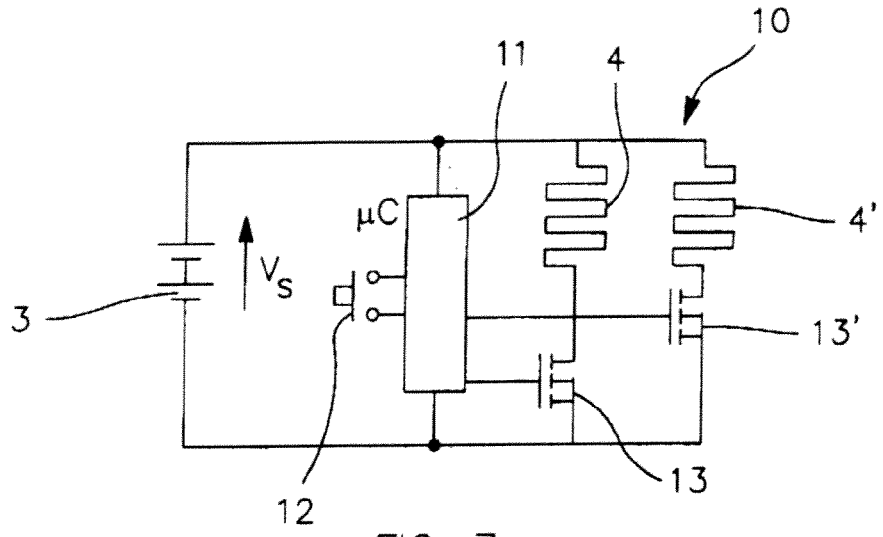
FIG. 7 is a circuit diagram showing a power-supply circuit in accordance with another exemplary embodiment of the present teachings.

As shown in FIG. 7, the device may include two heater members 4 and 4' that are suitable for being powered independently of each other, for example. By way of example, the two heater members are disposed on the substrate of the applicator device on the same side thereof, e.g. being superposed, interleaved, or juxtaposed. By way of example, the heater members 4 and 4' present different nominal working voltages $V_w$ and $V_w'$.

By way of example, the heater member 4 has a nominal working voltage $V_w$ that is greater than a predefined threshold voltage $V_{thresh}$, and the heater member 4' has a nominal working voltage $V_w'$ that is less than the threshold voltage $V_{thresh}$. The value of the threshold voltage can be stored in the micro-controller. By way of example, $V_{thresh}$ equals about $0.8\,V_{smax}$.

The control means 11 for controlling the power supply is configured to measure the voltage $V_s$ of the independent electrical energy source, and to select the heater member(s) to be powered as a function of the voltage $V_s$ and/or of the operating stage, namely heating up the electrical heater member or maintaining said electrical heater member at the working temperature.

Figure 8:
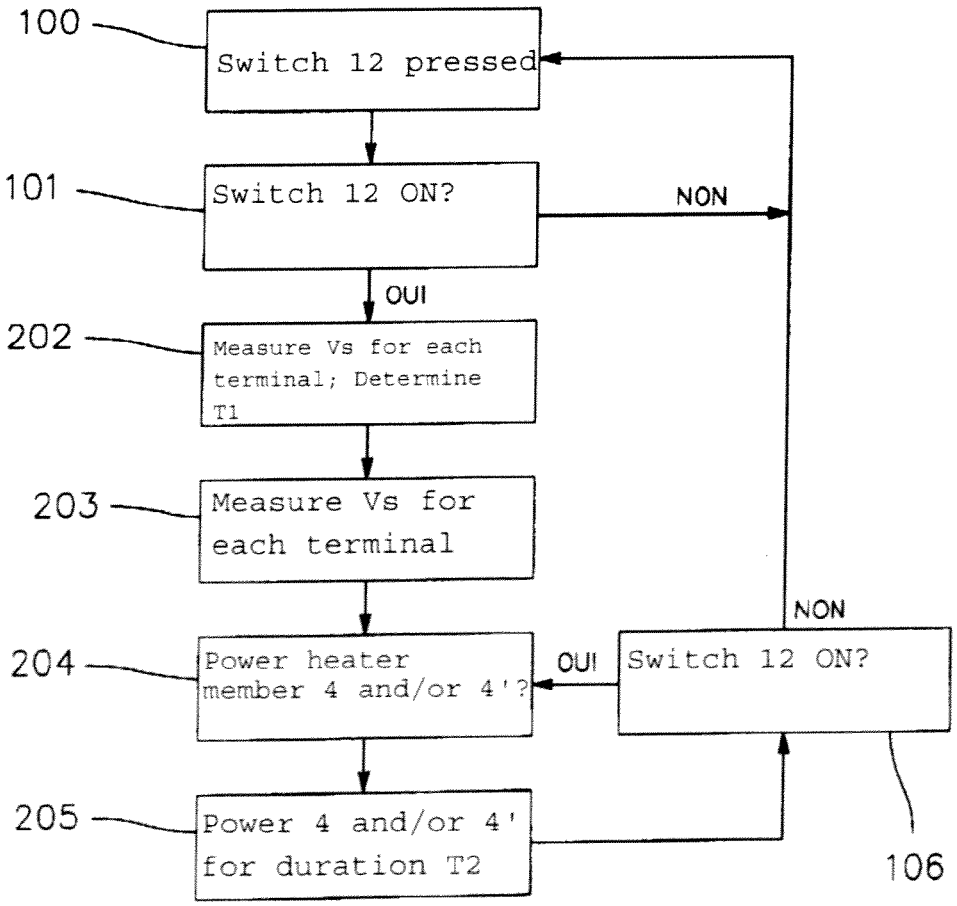
FIG. 8 is a block diagram showing a method of controlling a power supply according to another exemplary embodiment of the present teachings.

The device corresponding to the FIG. 7 diagram may function at least three power settings, as shown in FIG. 8.

Figure 5:
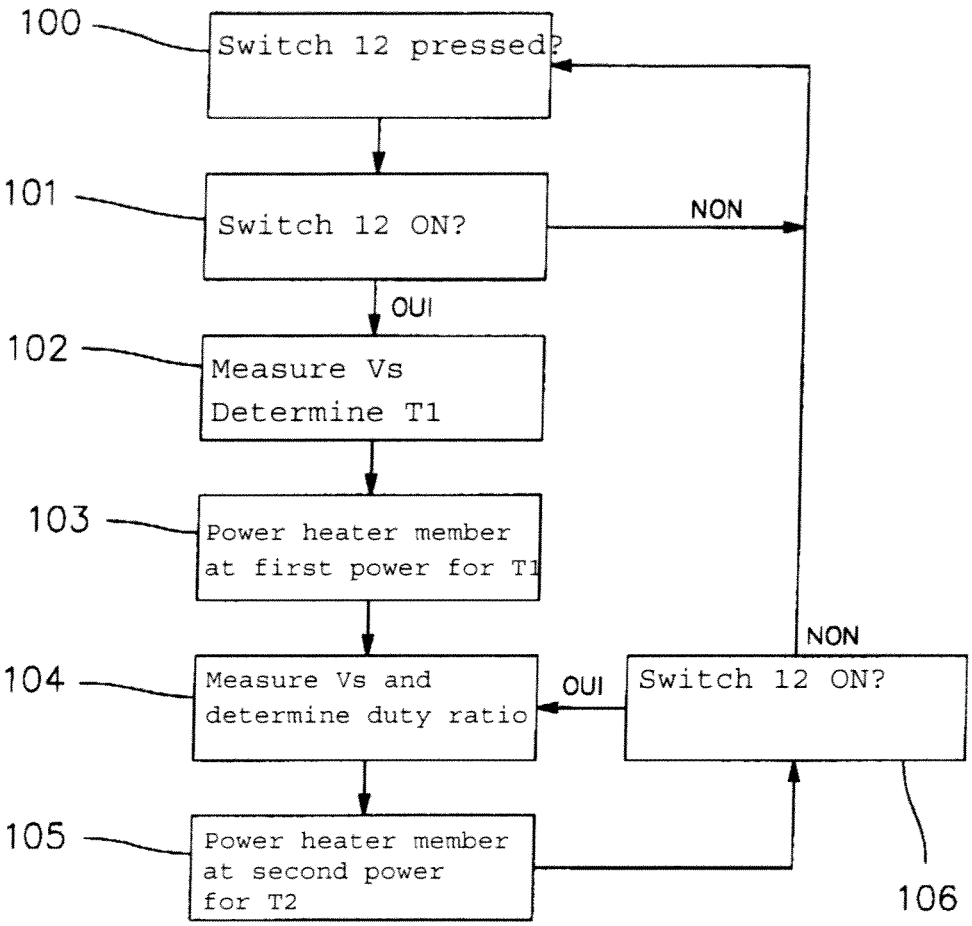
FIG. 5 is a block diagram showing a method of controlling a power supply according to an exemplary embodiment of the present teachings.

Steps 100 and 101 in FIG. 8 are similar to the steps described with reference to FIG. 5. At step 202, the control means 11 for controlling the power supply causes power to be supplied simultaneously to both heater members 4 and 4' by acting on the associated switch members 13 and 13', and they measure the voltage $V_s$ at the terminals of the source 3.

In a manner similar to that which is described above for step 102 in FIG. 5, the control means 11 may in this step 202 determine the duration $T_1$ of the first power setting as a function of a match from a correspondence table between the initial voltage $V_s$ and the duration $T_1$ stored in the micro-controller.

By way of example, the duration $T_1$ corresponds to the time that enables the applicator to reach the desired temperature, and could thus be shorter when the independent energy source is completely charged, and longer after said independent energy source is partially depleted.

In this first stage, the heater members 4 and 4' are powered simultaneously, for example.

At step 203, after this stage of heating up the applicator, the voltage $V_s$ at the terminals of the independent electrical energy source is measured once again.

At step 204, depending on the value measured and the nominal working voltage of each of the heater members 4 and 4', the control means 11 determine which of the heater members 4 or 4' should be powered.

For example, if the voltage $V_s$ is greater than the threshold voltage, the heater member 4 is powered at a second power setting at step 205, and if the voltage $V_s$ is less than the threshold voltage, the heater member 4' is powered at a third power setting at step 205.

In a variant, at step 205, the heater members may be powered in continuous manner or with a predefined duty ratio that depends on the voltage $V_s$.

Step 205 is performed for a predefined duration $T_2$.

Step 106 is similar to the step described with reference to FIG. 5.

Figure 9:
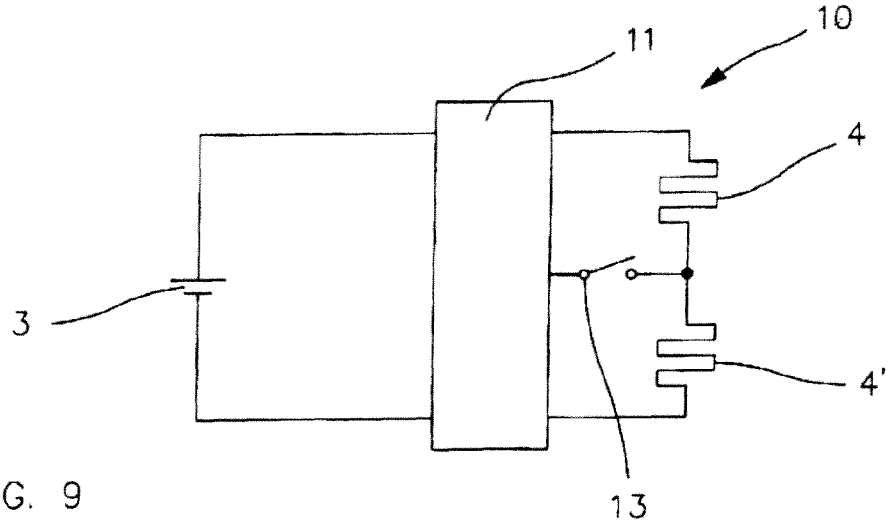
FIG. 9 is a circuit diagram showing a power-supply circuit in accordance with yet another exemplary embodiment of the present teachings.

In the exemplary embodiment in FIG. 9, the two heater members 4 and 4' are electrically connected in series, and may optionally be connected to a mid-point which makes it possible to power only one of the heater members 4, 4' by short-circuiting the other heater member 4, 4', for example.

The present teachings and claims are not limited to the exemplary embodiments described above.

The applicator device may include any number of heater members, including more than two heater members.

When the device includes more than one heater member, the housing can include a switch for switching on the heater member.

The control means for controlling the power supply to the heater member need not comprise a micro-controller. By way of example only, a dedicated analog circuit may be used in lieu of a micro-controller.

In another exemplary embodiment of the present teachings, the current flowing through the heater member may be measured in order to detect depletion of the source, and the duty ratio may be increased and/or the voltage raised in order to maintain the current at a predefined value.

The characteristics of the exemplary embodiments shown may be combined together within variants that are not shown.

The expression "comprising a" should be understood as being synonymous with "comprising at least one".

Although the present invention herein has been described with reference to exemplary embodiments, it is to be understood that these embodiments are merely illustrative of the principles and applications of the present teachings. Those ordinarily skilled in the art would understand, therefore, that numerous modifications may be made to the illustrative embodiments and that other arrangements may be devised without departing from the spirit and scope of the present teachings and claims.

What is claimed is:

1. A device for applying a cosmetic composition, the device comprising:

a battery power source;

at least one heater member that is powered by the battery power source; and a circuit for controlling the power supply to the heater member, the circuit being configured to power the heater member at at least two power settings selected depending on the depletion state of the battery power source, wherein the circuit for controlling the power supply to the heater member is configured to operate at a first low-power setting to transfer to the heater member only a fraction of the electric power that can be supplied thereto by the battery power source, the first low-power setting corresponding to when both the following conditions are met: the battery power source is at full capacity, and the heater member is to be maintained at a service temperature, and wherein the circuit for controlling the power supply is configured to operate at a second full-power setting to power the heater member with all of the electric power that can be supplied by the batter power source, the second full-power setting corresponding to when the heater member is brought from ambient temperature to its service temperature, or to when a remaining capacity of the battery power source is less than a predefined degree of depletion.

2. A device according to claim 1, wherein the circuit for controlling the power supply comprises a chopper power supply.

3. A device according to claim 2, wherein the chopper power supply is configured to function in a step-down mode at one of the power settings to power the heater member at a mean voltage that is less than the voltage of the battery power source.

4. A device according to claim 3, wherein the chopper power supply is configured to function in step-up mode at one of the power settings in order to power the heater member at a mean voltage that is greater than the voltage of the battery power source.

5. A device according to claim 1, wherein the circuit for controlling the power supply comprises at least one micro-controller and an electronic switch member that is controlled by the micro-controller.

6. A device according to claim 5, wherein the heater member is connected in series with the electronic switch member.

7. A device according to claim 1, wherein the circuit for controlling the power supply is arranged to power the heater member in a continuous manner at one of the power settings, and cyclically with a duty ratio at another of the power settings.

8. A device according to claim 7, wherein the duty ratio ranges from about 10% to about 100%.

9. A device according to claim 7, wherein the duty ratio ranges from about 67% to about 100%.

10. A device according to claim 7, wherein the duty ratio is determined by the depletion state of the battery power source.

11. A device according to claim 1, wherein the circuit for controlling the power supply to the heater member is configured to select a power setting of the heater member as a function of the depletion state of the battery power source and as a function of an operating stage selected from: maintaining the heater member at a service temperature; and heating the heater member up from ambient temperature to the service temperature or to a higher temperature.

12. A device according to claim 1, wherein the at least one heater member comprises two heater members, and the circuit for controlling the power supply is configured to power the heater members as a function of the depletion state of the battery power source.

13. A device according to claim 1, wherein the circuit for controlling the power supply comprises a timer system that is configured to limit at least one of the power settings to a predefined duration.

14. A device according to claim 1, further comprising an audible indicator and/or a visible indicator for signaling the depletion of the battery power source and/or for signaling if the temperature of the heater member reaches a predetermined value.

15. A device according to claim 1, wherein a voltage of the battery power source at full capacity is greater than a nominal voltage of the heater member required to maintain the heater member at its service temperature when powered continuously.

16. A device according to claim 15, wherein the voltage of the battery power source at full capacity is greater than 1.2 times the nominal voltage of the heater member.

17. A device according to claim 1, wherein the circuit is arranged to measure the voltage of the battery power source upon switching on the device, and to power the heater member continuously for a predetermined duration as a function of the measured voltage to bring the heater member to its service temperature or to a higher temperature to take up the composition.

18. A device according to claim 1, wherein the heater member is configured to be powered with a variable duty ratio, the power settings differing in their duty ratios.

19. A device for applying a cosmetic composition, the device comprising:

a battery power source;

at least one heater member that is powered by the battery power source; and a circuit for controlling the power supply to the heater member, the circuit being configured to power the heater member at at least two power settings selected depending on the depletion state of the battery power source, wherein the circuit for controlling the power supply comprises a chopper power supply, the chopper power supply being configured to function in a step-up mode at one of the power settings in order to power the heater member at a mean voltage that is greater than the voltage of the battery power source.

20. A device for applying a cosmetic composition, the device comprising:

a battery power source;

two heater members, each having a nominal voltage for operation and powered by the battery power source; and a circuit for controlling the power supply to the heater members, the circuit being configured to power each of the heater members at at least two settings selected depending on the depletion state of the battery power source, wherein the circuit for controlling the power supply is configured to power one or the other of the heater members depending on their nominal working voltage.

* * * * *